United States Patent [19]

Scheiwiller

[11] Patent Number: 4,965,978

[45] Date of Patent: Oct. 30, 1990

[54] SPACERS FOR THE CONSTRUCTION OF WALLS FROM SUPERIMPOSED BLOCKS

[76] Inventor: Rolf Scheiwiller, Buolterlistrasse 9, CH-6052 Hergiswil, Switzerland

[21] Appl. No.: 362,813

[22] Filed: Jun. 7, 1989

[30] Foreign Application Priority Data

Jun. 14, 1988 [EP] European Pat. Off. ..... 88810401.5

[51] Int. Cl.[5] ..... E04C 1/10; E04B 2/46

[52] U.S. Cl. ..... 52/438; 52/421; 52/442; 52/585

[58] Field of Search ..... 52/438, 442, 585, 687, 52/699, 421, 677; 405/47

[56] References Cited

U.S. PATENT DOCUMENTS

| | | | |
|---|---|---|---|
| 1,051,427 | 1/1913 | McCluskey . | |
| 3,054,266 | 9/1962 | Esch | 52/585 |
| 3,479,782 | 11/1969 | Muse . | |
| 4,091,587 | 5/1978 | Depka | 52/421 |
| 4,454,699 | 6/1984 | Strobl . | |
| 4,831,803 | 5/1989 | Leonardis | 52/585 |
| 4,833,857 | 5/1989 | Wheeler | 52/687 |

FOREIGN PATENT DOCUMENTS

| | | | |
|---|---|---|---|
| 170840 | 2/1986 | European Pat. Off. | 52/421 |

*Primary Examiner*—John E. Murtagh

*Attorney, Agent, or Firm*—Marks Murase & White

[57] ABSTRACT

The spacer for the construction of walls from superimposed blocks which have at least one opening on their horizontal sides is provided with a supporting member consisting of four spacing members which are radially symmetrically attached to a holding ring and which are located outside the opening of the block when laid, and with centering means consisting of centering tabs attached to the holding ring. In the case of the spacer for the construction of dry walls, the spacing members are attached to a connecting ring which is linked to the holding ring, the two rings together having a T-shaped cross-section. The centering tabs are each provided with a reinforcement tab extending inwards, which has a T-shaped cross-section together with the centering tab.

Such a spacer enables a safe, motionless and torsionally stiff support of the wall blocks and is well suited for mass production.

22 Claims, 3 Drawing Sheets

SPACERS FOR THE CONSTRUCTION OF WALLS FROM SUPERIMPOSED BLOCKS

BACKGROUND OF THE INVENTION

This invention relates to a spacer for the construction of walls from superimposed blocks which have at least one opening on their horizontal sides, the spacer having centering means projecting into an opening of each block below and above as well as a supporting means for the blocks. A spacer of this kind in the form of a single piece injection-moulded ring is known from EP-A-170 840 and is used primarily for the erection of so-called dry walls. In a known dry wall system, for example as described in DE-C-26 50 292, the stacked blocks have plugs on one side and corresponding recesses on the other horizontal side, a concentric offset collar being provided which on the one hand ensures that there is a distance between the blocks and on the other hand prevents injury through fingers becoming trapped when these blocks are laid. As the manufacture of these blocks with plugs and collars is relatively expensive, the abovementioned spacer was created in order that flat blocks with a through recess could be manufactured, which permits considerably more economic and rational manufacture. With the known spacer, the blocks rest on a relatively narrow continuous ring.

Different problems arise from the fact that the heavy blocks rest on a continuous ring each, for unevennesses of the blocks' surface, partly depending on their manufacture, are poorly compensated for, so that the upper layers of blocks may rock or the ring breaks. In addition, there is a danger that the supporting ring may become twisted.

SUMMARY OF THE INVENTION

In contrast, the object of this invention is to provide a spacer which provides a better support for the overlying blocks. A further object of one embodiment is to achieve increased torsional stiffness and safe building height of the wall without filling up the openings of the blocks.

This first object is attained by all the spacers defined by FIGS. 1–10, whereas the second object is attained by the spacer defined in FIGS. 5 and 6.

BRIEF DESCRIPTION OF THE DRAWINGS

The invention is more particularly described below with reference to drawings of embodiments.

DETAILED DESCRIPTION OF THE INVENTION

Figure 1:
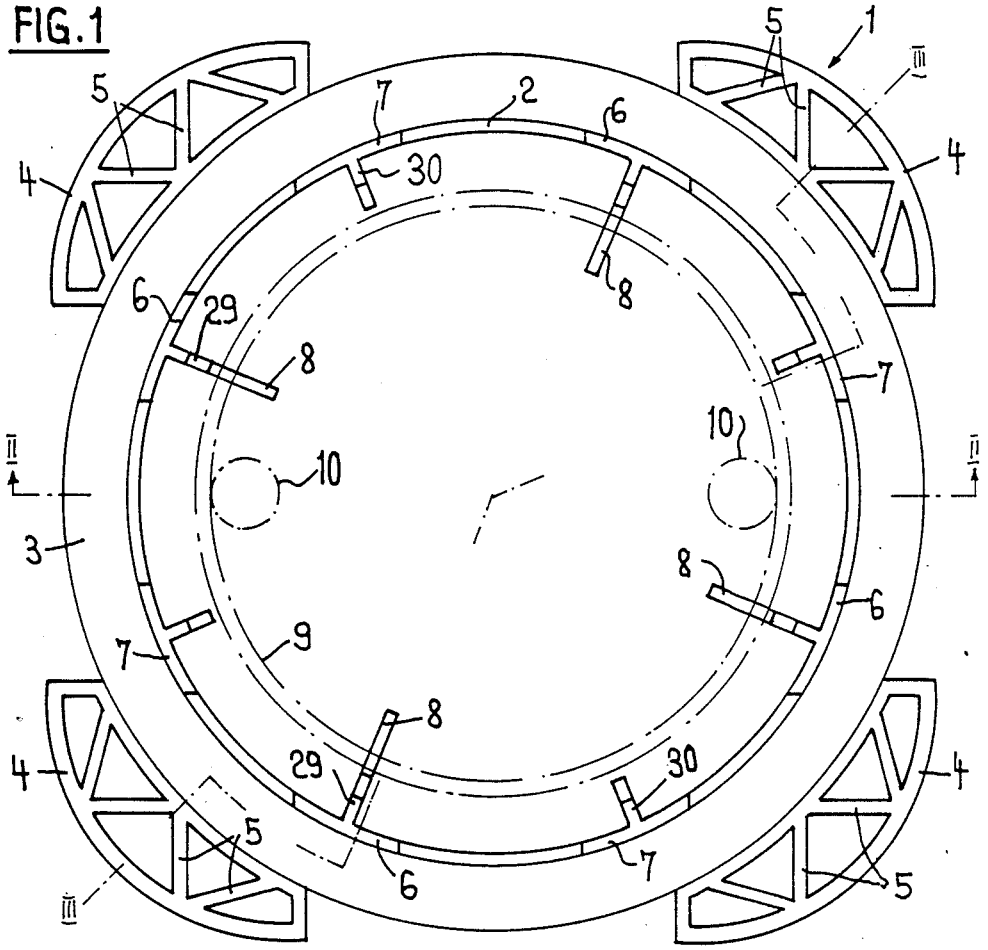
FIG. 1 shows a first embodiment of a spacer according to the invention in plan view.
Figure 2:
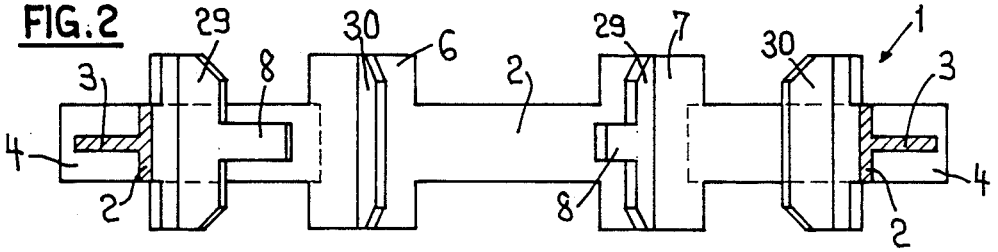
FIG. 2 shows a section through the spacer according to the line II—II in FIG. 1.
Figure 3:
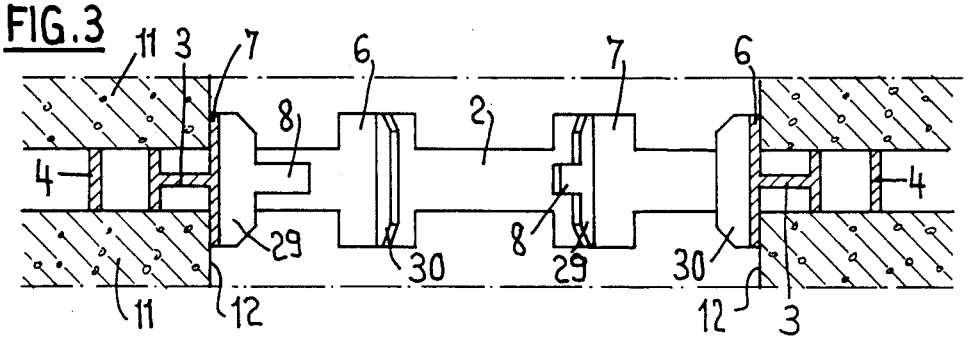
FIG. 3 shows a section through the spacer according to the III—III, when laid.
Figure 4:
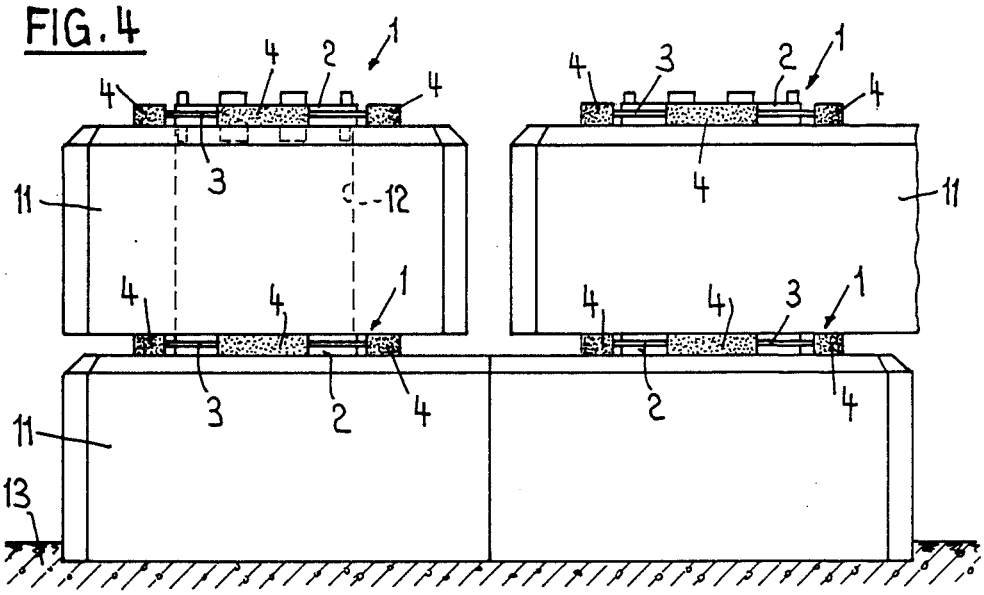
FIG. 4 shows a wall portion constructed with spacers in accordance with FIG. 1.

In the first embodiment according to FIGS. 1 to 3, the spacer 1 with the holding ring 2 is shown, to which (see FIG. 2) a short tube-like connecting ring is perpendicularly attached, the holding ring together with the connecting ring having a T-shaped cross-section. This results in a great torsional stability. Four spacing members 4 are disposed around the connecting ring 3, which are designed to take up the weight of the blocks. On principle, three spacing members would be sufficient for a stable support of the overlying blocks, but four spacing members have been chosen for reasons of symmetry. The spacing members 4 have an annular form and are provided with bracings 5 in order to give them the necessary strength. Moreover, the bracings are disposed in such a manner that, together with the annular wall, triangles turned by 180° with respect to each other are alternately formed. Thereby, maximum stability with minimum material consumption is realized. Over the circumference of the holding ring 2, centering tabs 6 and 7 are disposed at regular intervals, in the center of which reinforcement tabs 29 and 30 pointing inwards are attached. Each reinforcement tab runs into a supporting fin 8 pointing inwards. In the present embodiment, this is the case with the four reinforcement tabs 29, while the four reinforcement tabs 30 are shorter. The number of centering tabs is not critical, i.e. there might as well be more or less centering tabs. As can be seen in FIGS. 2 and 3, the holding ring's diameter is somewhat smaller than the diameter of the opening 12 in the block 11, so that the blocks do not rest thereon but on the spacing members exclusively. The supporting fins 8 have the task of receiving reinforcement steel rings 9 which serve to fill up the block openings. Vertically disposed reinforcement rods 10 are secured to the reinforcement steel rings 9. Filling up the walls is necessary especially when the construction height exceeds a certain prescribed construction height or when the terrain requires it. Furthermore, FIG. 3 illustrates the two courses of blocks 11 with their openings 12. These may be wall blocks having the appearance of those according to DE-C-26 50 292, of course without the plugs and the concentric offset collars around the plugs. The spacer according to FIGS. 1 to 3 is expediently injection-moulded in one piece from plastics, its form as well as the disposition of the centering tabs and the spacing members being directed to the construction of a relatively simple mold in order to provide for most economical production in big series. FIG. 4 schematically illustrates two superimposed layers of blocks, the bottom layer being anchored in the foundation 13. As plastics materials normally have relatively smooth surfaces, and, consequently, a different reflexion coefficient than the wall blocks, the outer surfaces of the spacers which are visible when laid are optically roughened in order to diminish their visibility, particularly when exposed to light.

Figure 5:
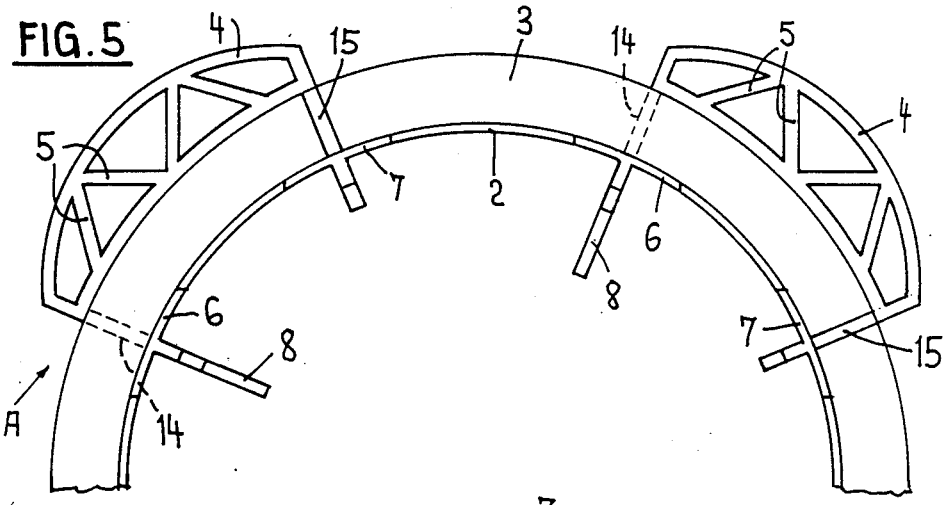
FIG. 5 shows an alternative embodiment of the spacer according to FIG. 1.
Figure 6:
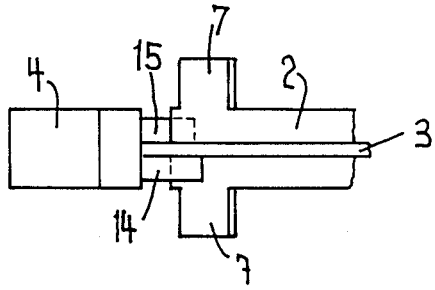
FIG. 6 shows a side view of the spacer according to FIG. 5, as viewed from A.
Figure 7:
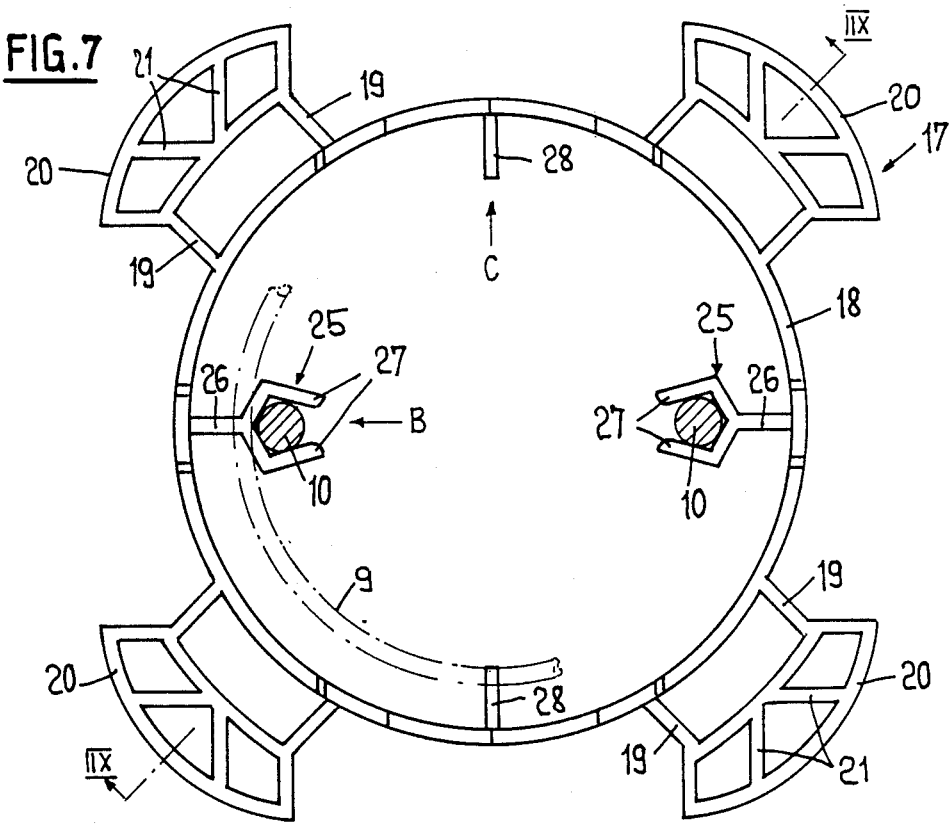
FIG. 7 shows a second embodiment of a spacer in plan view.
Figure 8:
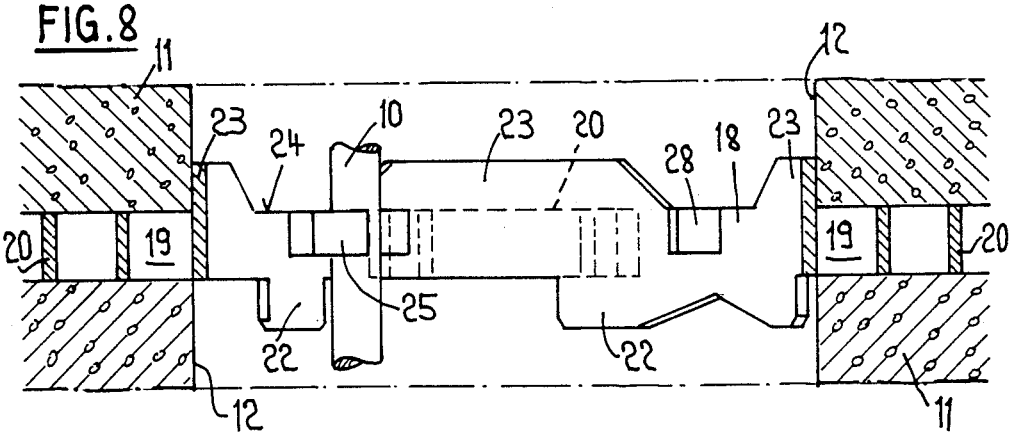
FIG. 8 shows a section of FIG. 7 according to the line IIX—IIX in FIG. 7, FIGS. 9 and 10 are views of the embodiment according to FIG. 7 as seen from B, respectively C.
Figure 9:
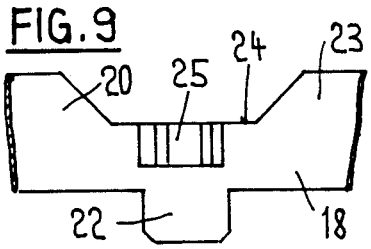
Figure 10:
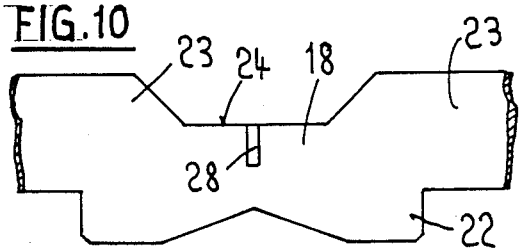

In the alternative embodiment of FIGS. 5 and 6, the connecting ring 3 is additionally reinforced near the spacing members through the two reinforcement tabs 29 and 30 being connected with the ends of the spacing members by reinforcement ribs 14 and 15, one reinforcement rib, 14, being provided underneath the connecting ring, and the other, 15, above it.

Besides, it is apparent from FIG. 2 and 3 in particular that the reinforcement tabs have a chamber 16 on both sides on the inside in order to save material.

In the second embodiment according to FIGS. 7 to 10, the spacer 17 is primarily intended for walls which are filled in with concrete, although for few layers, this spacer is also appropriate. The spacer 17 essentially consists of a holding ring 18, to which four spacing members 20 are attached by two webs 19 each, and which are similar in construction to the spacing member 4 of the first embodiment and are also provided with oblique bracings 21.

The holding ring 18 is provided with centering tabs extending upwards and downwards which are distributed over the entire circumference, the centering tabs 22 extending downwards being less in number than the centering tabs 23 extending upwards. In other words, the holding ring 18, which has the form of a centering ring, has less and smaller recesses 24 on its upper side than below, whereby this spacer isn't fully symmetrical any more. This means that during construction, the upper side must in fact face upwards because its centering function is more pronounced in this direction than facing downwards, the bottom part already centering the block essentially.

As already mentioned, the spacers 17 are intended for walls which are to be filled in with concrete, and therefore, means are provided for securing the vertical reinforcement rods 10, on the one hand, and the reinforcement steel rings 9 on the other. The two vertical reinforcement rods 10 are seized by a fork-shaped holder 25 each, the fork web 26 being attached to the holding ring 18. The two fork prongs are formed to be elastic. The reinforcement steel rings 9 rest on two supporting fins 28. Both near the forks and near the supporting fins, the centering ring has recesses 24 so that the reinforcement rods or the reinforcement steel rings may easily be secured there by means of wire if necessary. This spacer as well is generally injection-moulded in one piece from plastics and is provided with optically roughened lateral surfaces.

As follows from the above description, both embodiments have in common that the individual, symmetrically disposed spacing members allow to avoid unevennesses of the blocks, production techniques implying certain unevennesses, respectively continuous bulges. Secure support of the blocks results, while the torsion-proof construction of the spacing members and, in the case of the first embodiment, of the T-shaped cross-section of the holding ring and connecting ring assembly, provides for motionless support of the wall blocks which can be stacked to a height of over a meter without having to be concreted-in, which wasn't possible before.

I claim:

1. A spacer comprising a substantially circular ring having an interior and an exterior;

means for centering said spacer in a block having an interior opening, said means for centering connected to the interior of said ring; and a plurality of substantially horizontal evenly spaced spacing members, each of said spacing members having an inner side which is connected with the exterior of said ring, an outer side, at least two lateral sides and a plurality of bracings extending between the outer side and inner side of said spacing members, the bracings being triangularly disposed.

2. A spacer comprising a substantially circular connecting ring having an interior and an exterior;

a short, tube-like holding ring disposed on the interior of said connecting ring, said holding ring having a plurality of substantially vertical centering tabs integral with, vertically larger than and evenly disposed on said holding ring, and a reinforcing tab substantially perpendicular to said centering tab and directed inwardly, and a plurality of substantially horizontal, evenly spaced spacing members, each of said spacing members having an inner side which is connected with the exterior of said connecting ring, an outer side, at least two lateral sides and a plurality of bracings extending between the outer side and inner side of said spacing members, the bracings being triangularly disposed.

3. A spacer as in claim 1, wherein the inner side of said spacing member is flush with the exterior of said ring.

4. A spacer as in claim 1, wherein said spacing members each have an exterior and the exterior of said ring and of said spacing members are roughened so as to diminish the visibility of said spacer when positioned between two blocks.

5. A spacer as in claim 1, wherein said means for centering further comprises a short, tube-like holding ring disposed on the interior of said substantially circular ring, said holding ring having a plurality of substantially vertical centering tabs integral with, vertically larger than and evenly disposed on said holding ring, and a plurality of reinforcing tabs substantially perpendicular to said centering tabs and directed inwardly.

6. A spacer as in claim 5, wherein the reinforcing tabs have an inner end distant from the centering tabs and at least one reinforcing tab has a supporting fin connected to the inner end of the reinforcing tab.

7. A spacer as in claim 6, wherein every second reinforcing tab has a supporting fin.

8. A spacer as in claim 5, wherein said substantially circular ring has a top side and a bottom side and each of said spacing members has a first and a second lateral side.

9. A spacer as in claim 8, wherein the first lateral side is connected to a reinforcing tab by a reinforcement rib disposed on the top of said substantially circular ring and the second lateral side is connected to another reinforcing tab by a reinforcement rib disposed on the bottom of said substantially circular ring.

10. A spacer as in claim 1, wherein said ring has the form of a short tube.

11. A spacer as in claim 10, wherein the inner side of said spacing member is connected to the exterior of said ring by at least two substantially vertical webs.

12. A spacer as in claim 11, wherein said means for centering further comprises a plurality of substantially vertical centering tabs integral with, vertically larger than and evenly disposed on said ring.

13. A spacer as in claim 12, wherein said ring has an upper and lower surface and said centering tabs extend higher than the upper surface and lower than the lower surface of said ring.

14. A spacer as in claim 13, wherein a greater number of centering tabs extends higher than the upper surface of said ring than lower than the lower surface of said ring.

15. A spacer as in claim 12, wherein at least one means for securing a vertical rod is connected to the interior of said ring.

16. A spacer as in claim 15, wherein said means for securing a vertical rod comprises a fork web connected to and substantially perpendicular to the inside of said ring, said fork web having a inside end distant from said ring, and at least two fork prongs for holding the vertical rod, said fork prongs being connected to the inside end of said fork web.

17. A spacer as in claim 15, wherein at least two means for supporting a steel ring are connected to the interior of said ring.

18. A spacer as in claim 17, wherein said means for supporting a steel ring comprises a substantially vertical supporting fin substantially perpendicular to the interior of said ring.

19. A spacer as in claim 1, wherein said spacer is injection-molded in one piece from a plastic material.

20. A spacer as in claim 1, wherein said spacer has a substantially radial-symmetrical form.

21. A spacer comprising a short, tube-like, substantially circular ring having an interior and an exterior;

a plurality of substantially vertical centering tabs integral with vertically larger than and evenly disposed on said ring, which extend higher than and lower than said ring; and a plurality of substantially horizontal evenly spaced spacing members, each of said spacing members having an inner side which is connected with the exterior of said ring by at least two substantially vertical webs, an annular outer side, at least two lateral sides and a plurality of bracings extending between the outer side and inner side of said spacing members, the bracings being triangularly disposed.

22. A spacer comprising a short, tub-like substantially circular ring having an interior and an exterior;

a plurality of substantially vertical centering tabs integral with, vertically larger than and evenly disposed on said ring, which extend higher than and lower than said ring;

a plurality of substantially horizontal evenly spaced spacing members, each of said spacing members having an inner side which is connected with the exterior of said ring by at least two substantially vertical webs, ann annular outer side, at least two lateral sides and a plurality of bracings extending between the outer side and inner side of said spacing members, the bracings being triangularly disposed;

a fork web connected to and substantially perpendicular to the inside of said ring, said fork web having an inside end distant from said ring;

at least two fork prongs for holding a vertical rod, said fork prongs being connected to the inside end of said fork web; and at least two substantially vertical supporting fins connected to and substantially perpendicular to the interior of said ring.

* * * * *